US008878683B2

(12) United States Patent
Riedi

(10) Patent No.: US 8,878,683 B2
(45) Date of Patent: Nov. 4, 2014

(54) LIGHT RECEIVER DEVICE HAVING A SHIELDING DEVICE EXTENDING ON A BACK SIDE OF A SUBSTRATE

(75) Inventor: Urs Riedi, Jona (CH)

(73) Assignee: Siemens Aktiengesellschaft, Munich (DE)

( * ) Notice: Subject to any disclaimer, the term of this patent is extended or adjusted under 35 U.S.C. 154(b) by 723 days.

(21) Appl. No.: 13/126,867

(22) PCT Filed: Oct. 29, 2008

(86) PCT No.: PCT/EP2008/064657
§ 371 (c)(1),
(2), (4) Date: Jun. 29, 2011

(87) PCT Pub. No.: WO2010/048991
PCT Pub. Date: May 6, 2010

(65) Prior Publication Data

US 2011/0260876 A1 Oct. 27, 2011

(51) Int. Cl.
*G08B 17/10* (2006.01)

(52) U.S. Cl.
USPC ..... 340/630; 340/628; 250/239; 250/574

(58) Field of Classification Search
USPC ..... 340/630, 628, 632; 250/573, 574, 575, 250/239, 576; 356/338, 342, 346
See application file for complete search history.

(56) References Cited

U.S. PATENT DOCUMENTS

| | | | | |
|---|---|---|---|---|
| 4,897,634 | A | 1/1990 | Sawa et al. | |
| 5,138,302 | A * | 8/1992 | Nagaoka et al. | 340/630 |
| 5,400,014 | A * | 3/1995 | Behlke et al. | 340/630 |
| 5,642,099 | A * | 6/1997 | Nagashima | 340/630 |
| 5,898,377 | A | 4/1999 | Adachi | |
| 6,288,647 | B1 * | 9/2001 | Yamano | 340/630 |
| 6,737,977 | B2 | 5/2004 | Nishikawa et al. | |
| 6,756,905 | B2 * | 6/2004 | Rattman et al. | 340/630 |
| 2005/0057366 | A1 * | 3/2005 | Kadwell et al. | 340/630 |

FOREIGN PATENT DOCUMENTS

| | | | |
|---|---|---|---|
| DE | 9412367 | U1 | 9/1994 |
| EP | 0800153 | A2 | 10/1997 |
| EP | 1253566 | A2 | 10/2002 |

* cited by examiner

*Primary Examiner* — Hung T. Nguyen
(74) *Attorney, Agent, or Firm* — Laurence A. Greenberg; Werner H. Stemer; Ralph E. Locher

(57) ABSTRACT

A light receiver device, which is particularly suited for a smoke detector, has a flat substrate, a light receiver mounted on a front side of the substrate, and a shielding device present on at least a back side of the substrate opposite the front side. The shielding device is configured to at least partially shield against electromagnetic interference radiation impinging on the light receiver through the substrate. False alarms are thereby reduced, while the sensitivity of the light receiver is simultaneously increased. The shielding device is formed with a metal strip inserted through the substrate from the front side to the back side, and bent over a recess on the back side provided therefor, so that the light receiver is protected against interference radiation even on the back side. There is also provided an assembly method for producing a light receiver device.

9 Claims, 3 Drawing Sheets

LIGHT RECEIVER DEVICE HAVING A SHIELDING DEVICE EXTENDING ON A BACK SIDE OF A SUBSTRATE

BACKGROUND OF THE INVENTION

Field of the Invention

The present invention relates generally to the area of technology of shielding light receivers against electromagnetic interference radiation. The present invention relates specifically to a light receiver device, in particular for an optical smoke alarm, which light receiver device comprises a light receiver and a shielding device that are mounted on a common substrate. The present invention also relates to an assembly method for manufacturing a light receiver device of the aforementioned type.

In order to offer early detection of the unwanted occurrence of a hazardous situation such as for example the start of a fire, danger alarms are frequently used which are fitted at suitable locations in an area being monitored for dangers, for example inside a building. A danger alarm can also be a part of a danger alarm system or a comprehensive building management system which has a plurality of peripheral units in addition to a central control facility. In this situation, the peripheral units can be connected to the central control facility by way of a direct and/or an indirect communication link.

The peripheral units can perform different functions such as for example the detection of smoke or dangerous gases, the output of visual or audible alarm signals and/or the acceptance of manual emergency calls.

Smoke alarms in particular offer effective protection in a practical situation against the consequences of a fire. For this reason, smoke alarms are frequently used both in commercial and also in private premises. This situation has also been achieved on account of the fact that it has become possible in the past to construct reliable smoke alarms in a simple manner and using cost-effective components, with the result that smoke alarms have become a very economically priced product.

The majority of smoke alarms are based on the optical scattered light principle whereby a light beam emitted by a light source, for example a light emitting diode, is then only directed partially onto a light receiver, for example a photodiode, if a scattering medium is present in the region between light source and light receiver. The direct light beam from the light source does not impinge on the light receiver.

Since the intensity of the scattered light received by the light receiver is very low in particular with regard to a low smoke density, the light receiver should on the one hand have a high sensitivity to the scattered light to be sensed and on the other hand a low sensitivity to electromagnetic interference radiation. This means that the electromagnetic compatibility (EMC) of the light receiver should be as great as possible.

In order to improve the EMC of a light receiver used in a smoke alarm, the use is known of a metal shielding unit, which at least partially reduces the intensity of electromagnetic interference radiation, on the front side of a printed circuit board on which the light receiver is mounted. This measure is however not sufficient for those smoke alarms which have a particularly sensitive light receiver.

The device-related object of the invention is to create a light receiver device, in particular for an optical smoke alarm, which has a particularly high electromagnetic compatibility with respect to electromagnetic interference radiation. Furthermore, the method-related object of the invention is to create an efficient assembly method for manufacturing such a light receiver device.

BRIEF SUMMARY OF THE INVENTION

This object is achieved by the subject matter of the independent claims. Advantageous embodiments of the present invention are set down in the dependent claims.

According to a first aspect of the invention, a light receiver device is described which in particular is suitable for an optical smoke alarm. The light receiver device described comprises (a) a flat substrate, (b) a light receiver which is mounted on a front side of the substrate, and (c) a shielding device which is present on at least a back side of the substrate opposite the front side and which is designed such that it at least partially shields against electromagnetic interference radiation which impinges on the light receiver through the substrate.

The optical light receiver device described is based on the knowledge that the electromagnetic compatibility of the light receiver can be improved by mounting a suitable shielding on the back side of the substrate. This shielding is designed in such a manner that it attenuates electromagnetic interference radiation which impinges on the substrate from the back side, at least partially penetrates the substrate and impinges on the light receiver.

The term electromagnetic compatibility (EMC) refers in this context to the sensitivity of the entire optical light receiver device to electromagnetic interference radiation. That is to say, such interference radiation can corrupt the output signal from the light receiver to the effect that light reception is incorrectly assumed or that the measurement signal which results from light actually received cannot be output or cannot be correctly output in consequence of a greater interference signal.

The shielding device which is also present at least on the back side of the substrate can be designed and/or formed in many different ways. The shielding device can thus for example lie directly against the rear surface of the substrate. This form of embodiment is suitable in particular for a surface mount device (SMD) light receiver which is mounted by means of the so-called surface mounting technique on the front side of the substrate.

The shielding device can also extend out from the rear surface of the substrate such that a not inconsiderable portion of the shielding device exhibits a certain spacing from the rear surface of the substrate. This form of embodiment is suitable in particular for a light receiver mounted using through hole technology (THT) on the front side of the substrate, whereby in the mounted state connector pins are in each case inserted though a through-hole situated in the substrate and protrude on the back side of the substrate.

According to an exemplary embodiment of the invention, the shielding device has a metal strip which penetrates the substrate from the front side to the back side and is fixed in self-retaining fashion in the substrate in this situation.

The metal strip, which can also be referred to as a metal tab, can in this situation for example be a sheet which exhibits a sufficiently high stiffness to ensure that in particular on the back side of the substrate it is so dimensionally stable that it does not even deform at least in the event of slight vibrations of the entire light receiver device and can thus contribute to a uniformly electromagnetic shielding effect.

The self-retaining fixing of the shielding device can for example be effected by means of a barb or by means of a plurality of barbs mounted on the metal strip, which lock in the substrate material and/or in a so-called soldering lug which is affixed on the substrate. Likewise, the barbs can also be formed on a soldering lug of the shielding device or of the metal strip.

According to a further exemplary embodiment of the invention, the metal strip has at least one bulge. This has the advantage that the stiffness of the metal strip can be increased in the region of the at least one bulge in a simple and at the same time efficient manner.

According to a further exemplary embodiment of the invention, at least a partial section of the shielding device is introduced into the substrate by means of a push-in operation. This has the advantage that the shielding device can be fixed in or on the substrate in a simple manner. In this situation, the shielding device or the partial section of the shielding device can be designed in such a manner that it is not necessary to form a corresponding opening in the substrate before pushing in the partial section of the shielding device. In particular, at least the partial section which is introduced into the substrate can be suitably stiff and/or have a point and/or a sharp edge on its front side. The partial section of the shielding device can thus be pressed into the substrate and penetrate the substrate in this manner. The mounting of the shielding device in or on the substrate can thus be considerably simplified.

According to a further exemplary embodiment of the invention, the push-in operation involves pushing in at least the partial section of the shielding device from the front side of the substrate to the back side of the substrate.

The described pushing-in or pushing-through of at least one part of the shielding device, which part for example can be the metal strip described above, has the advantage that the shielding device can be mounted from the front side of the substrate in the same way as a photodiode mounted using through hole technology. As a result, it is advantageously not necessary to turn the substrate or to change the assembly direction between the assembly of the photodiode and the assembly of the shielding device which is on the back side with respect to the substrate. This is noteworthy inasmuch as at least one part of the partial section of the shielding device of the light receiver device described in this application is now situated on the back side of the substrate and thus on the side opposite the actual photodiode.

According to a further exemplary embodiment of the invention, the shielding device has a bend on the back side of the substrate which separates a first section of the shielding device and a second section of the shielding device from one another.

In particular, the first section of the shielding device can essentially extend perpendicular to the surface of the flat substrate, whereas the second section of the shielding device can essentially extend parallel to the substrate surface. In this situation, the first section can preferably be used for fixing the shielding device in or on the substrate. The second section can preferably be used for shielding from electromagnetic radiation which impinges on the light receiver from the back side of the substrate.

According to a further exemplary embodiment of the invention, the shielding device has a narrowing in the region of the bend. This has the advantage that during assembly of the shielding device a precisely defined bend can be implemented by means of a simple bending process. A special tool for producing the bend is advantageously not necessary. The bend can rather be achieved by simple manual bending of the shielding device.

According to a further exemplary embodiment of the invention, the shielding device has a front shielding unit and a rear shielding unit, whereby (a) the front shielding unit is situated on the front side of the substrate and (b) the rear shielding unit is situated on the back side of the substrate.

The front shielding unit can thus protect the light receiver against electromagnetic interference radiation which impinges on the light receiver from the front side of the substrate. The front shielding unit can also surround the light receiver laterally such that electromagnetic interference radiation impinging laterally on the light receiver is also at least partially shielded.

With the described combination of the front and rear shielding units it is thus possible to achieve a comprehensive shielding for the light receiver which almost completely surrounds the light receiver and thus offers optimum protection against electromagnetic interference radiation. The front shielding unit can naturally also have a gap through which measuring light that is to be detected by the light receiver is able to pass.

According to a further exemplary embodiment of the invention, the light receiver device additionally has a terminal contact for providing electrical contact with the shielding device.

The terminal contact described can for example be a connector pin situated in the substrate. The electrical contact can in particular be established by means of a soldered connection. By means of the soldered connection it is also possible to improve the mechanical stability of the shielding device with respect to the substrate.

In order to achieve as good a shielding effect as possible the terminal contact can be connected to a ground potential. This can preferably take place by means of a relatively large-surface conductor path which in a known manner can contribute to a reliable grounding contact.

According to a further exemplary embodiment of the invention, the substrate has a printed circuit board. This has the advantage that the light receiver device described can be formed on a simple substrate which in a known manner can additionally provide suitable connection options and conductor paths for making contact with the electronic components of the light receiver device.

According to a further exemplary embodiment of the invention, the substrate has a mechanical support element. The support element can for example be a plastic part formed by means of an injection molding process.

The support element can help to ensure that all or at least some of the components of the light receiver device described are fixed exactly in position. This should also apply when the light receiver device is subjected to certain mechanical vibrations.

It should be noted that the mechanical support element and the aforementioned printed circuit board can also jointly form the substrate described above. In particular, the push-in operation for the shielding device can also take place through the printed circuit board and the support element. The self-retention described above of the metal strip can in this situation be formed with respect to the printed circuit board and/or with respect to the mechanical support element. This also applies to a fixing effected by means of a barb or by means of a plurality of barbs.

According to a further exemplary embodiment of the invention, the light receiver is a photodiode. This has the advantage that the light receiver can be implemented by means of a simple and in particular by means of an inexpensive optoelectronic component. The light receiver device described therefore constitutes an optical device having a high electromagnetic compatibility which is also suitable for so-called low cost applications.

The photodiode can have a spectral sensitivity which is optimized to meet individual requirements in each case. In particular, for use in an optical smoke alarm the photodiode can have a high sensitivity in the near infrared spectral range, where simple light emitting diodes which are typically used as light sources have an especially high efficiency.

It should however be noted that the photodiode can also have a high detection sensitivity for electromagnetic radiation in the visible range or even in the near ultraviolet spectral range.

According to a further aspect of the invention, an assembly method for manufacturing a light receiver device is specified. The specified assembly method comprises (a) equipping a substrate with a light receiver on a front side of the substrate, and (b) mounting a shielding device on the substrate, such that the shielding device is situated at least on a back side of the substrate opposite the front side. In this situation, the shielding device is designed such that in the mounted state it at least partially shields against electromagnetic interference radiation which impinges on the light receiver through the substrate.

The described assembly method is based on the knowledge that the electromagnetic compatibility of the light receiver can be improved as a result of mounting a suitable shielding device on the back side of the substrate.

In this situation, the shielding device can have a metal strip which penetrates the substrate from the front side to the back side when the shielding device is mounted and is fixed in self-retaining fashion in the substrate in this situation.

According to an exemplary embodiment of the invention, at least one partial section of the shielding device is introduced into the substrate by means of a push-in operation.

The shielding device or the partial section of the shielding device which is pushed into the substrate can be designed in such a manner that it is not necessary to form a corresponding opening in the substrate before pushing in the partial section of the shielding device. This can be achieved for example due to the fact that at least the partial section which is introduced into the substrate has a sufficiently high stiffness. Moreover, the partial section can have a point or a sharp edge, such that the partial section can be pressed into the substrate and penetrates the substrate in this manner.

According to a further exemplary embodiment of the invention, the partial section is pushed into the substrate from the front side of the substrate to the back side of the substrate.

The described pushing-in or pushing-through of at least one part of the shielding device has the advantage that the shielding device can be mounted from the front side of the substrate in the same way as a photodiode mounted using through hole technology. As a result, it is advantageously not necessary to turn the substrate or to change the assembly direction between the assembly of the photodiode and the assembly of the shielding device on the back side of the substrate.

By preference, first the light receiver is mounted on the substrate and then the shielding device is assembled on the substrate. This is advantageous in particular in the situation when the shielding device has a front shielding unit and a rear shielding unit and when the front shielding unit at least partially surrounds the light receiver on the front side of the light receiver device.

After the shielding device has been mounted, the aforementioned metal strip can optionally be bent in such a manner that a first section of the shielding device essentially extends perpendicular to the surface of the flat substrate, whereas a second section of the shielding device essentially extends parallel to the substrate surface.

It should be noted that embodiments of the invention have been described with reference to different invention subjects. In particular, some embodiments of the invention are described with device claims and other embodiments of the invention with method claims. However, a person skilled in the art will immediately become aware on reading this application that, unless explicitly stated otherwise, any desired combination of features belonging to different types of invention subject is possible as well as a combination of features belonging to one type of invention subject.

Further advantages and features of the present invention will emerge from the following exemplary description of currently preferred embodiments. The individual figures of the drawing of this application are merely to be seen as schematic and not to scale.

DESCRIPTION OF THE INVENTION

Figure 1:
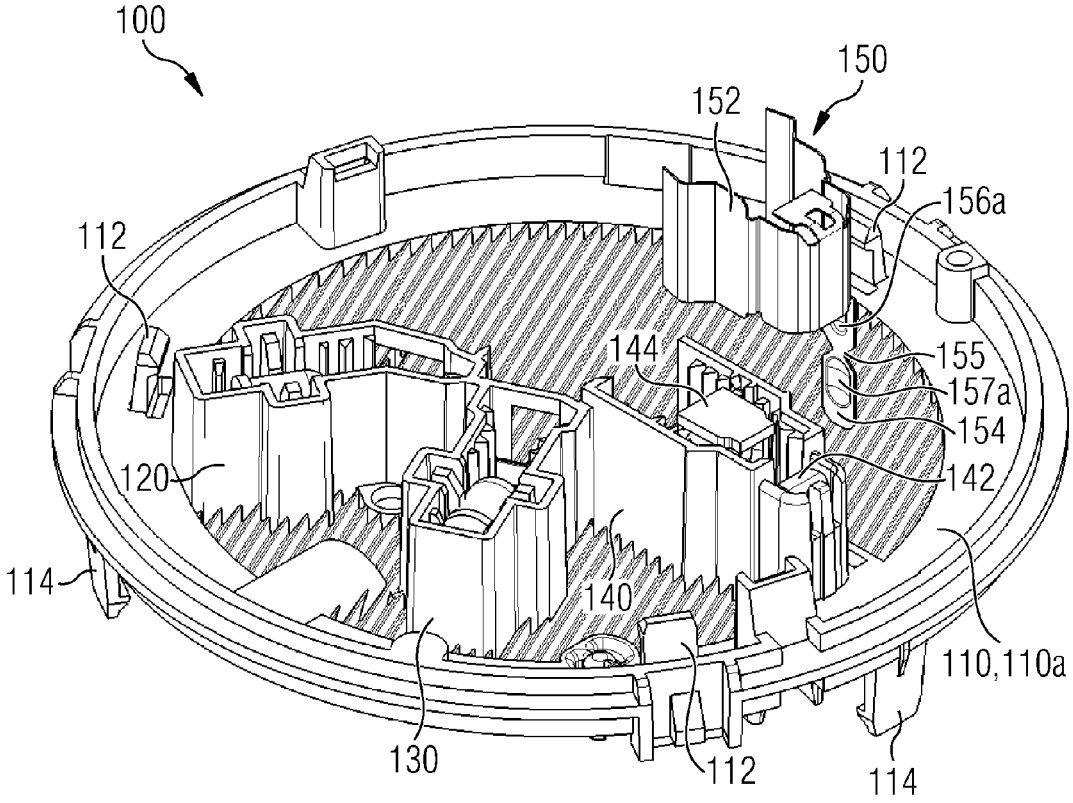
FIG. 1 shows a perspective view of the installation of a shielding device into a substrate of a smoke alarm, on which substrate all the optoelectronic components of the smoke alarm are situated.

It should be noted at this point that the reference characters of identical or corresponding components differ from one another only in their first digit.

It should also be noted that embodiments described in the following merely represent a restricted selection of possible embodiment variants of the invention. In particular, it is possible to combine the features of individual embodiments with each other in a suitable manner so that, for the person skilled in the art, a plurality of different embodiments is to be regarded as obviously disclosed with the embodiment variants explicitly illustrated here.

FIG. 1 shows the installation of a shielding device 150 into a substrate 110 of a smoke alarm 100. The substrate 110 comprises a mechanical support element 110*a* and a printed circuit board, whereby the printed circuit board is not visible in the perspective view shown in FIG. 1.

On the mechanical support element 110*a* are formed snap hooks 112 which are provided for holding a cover (not shown) of the smoke alarm 100. The cover serves in a known manner to avoid any contamination of the smoke alarm and to keep away insects which may trigger false alarms if they intrude into the interior of the smoke alarm 100.

Also formed on the mechanical support element 110*a* are snap hooks 114 which serve in a known manner to secure the smoke alarm 100 on an adapter plate (not shown in FIG. 1). The adapter plate can for example be secured on the wall or in particular on the ceiling of a room to be monitored. Thereafter the smoke alarm 100 only needs to be latched into the adapter plate by means of the snap hooks 114.

The smoke alarm 100 based on the optical scattered light principle comprises a first light emitting device 120 and a second light emitting device 130. The light emitting devices 120, 130 each comprise a light source and an optical system. The light source of the first light emitting device 120 can emit light having a first wavelength and the light source of the second light emitting device 130 can emit light having a second wavelength. Since the construction of the spectrally different light emitting devices 120, 130 is known and is of no further relevance to the invention described in this application, this application will not expand further on the technical details of the light emitting devices 120, 130.

As can be seen from FIG. 1, the smoke alarm 100 also comprises a light receiver device 140. The light receiver device 140 comprises a light receiver 142 taking the form of a photodiode and a receiver lens 144. Since the scattered light intensity in particular in the case of a low smoke concentration is normally not very great, a shielding device 150 which at least partially attenuates the intensity of electromagnetic interference radiation impinging on the light receiver device 140 from outside is provided for the light receiver device 140. The sensitivity of the light receiver device 140 and with it the sensitivity of the entire smoke alarm 100 are thus considerably improved by the shielding device 150 and the probability of false alarms occurring is considerably reduced at the same time.

FIG. 1 shows the shielding device 150 shortly prior to assembly on the substrate 110. With respect to the light receiver device 140, the shielding device 150 is therefore not yet situated at the point at which the shielding device 150 is able to exert its shielding effect for the light receiver device 140 and in particular for the photodiode 142.

According to the exemplary embodiment described here, the shielding device 150 comprises a front shielding unit 152 and a rear shielding unit 154. In the installed state, which will be described in more detail in the following, the front shielding unit 152 serves to shield against electromagnetic interference radiation which in FIG. 1 impinges on the light receiver device 140 from above or laterally from above. The rear shielding unit 154 serves to shield against electromagnetic interference radiation which in FIG. 1 impinges on the light receiver device 140 from below or laterally from below through the substrate 110.

According to the exemplary embodiment described here, the rear shielding unit takes the form of a metal strip 154. In order to increase the stiffness of the metal strip 154 two bulges are provided, a first bulge 156*a* and a second bulge 157*a*. Between the two bulges 156*a*, 157*a* the metal strip 154 has a narrowing which, as will be described in detail in the following, is intended to facilitate a bending of the metal strip 154*b* at the end of assembly of the shielding device 350.

The assembly of the shielding device 150 on the substrate 110 takes place according to the exemplary embodiment described here in a simple manner by pressing the metal strip 154 exhibiting a certain stiffness through the substrate 110. In this situation, it is not necessary to pre-drill or form a through-hole in the substrate 110. At the end of the push-in operation the shielding device 150 is fixed in self-retaining fashion in the substrate 110. The self-retaining fixing of the shielding device 150 can be improved for example by means of barbs (not shown) which lock into the substrate material.

Figure 2A:
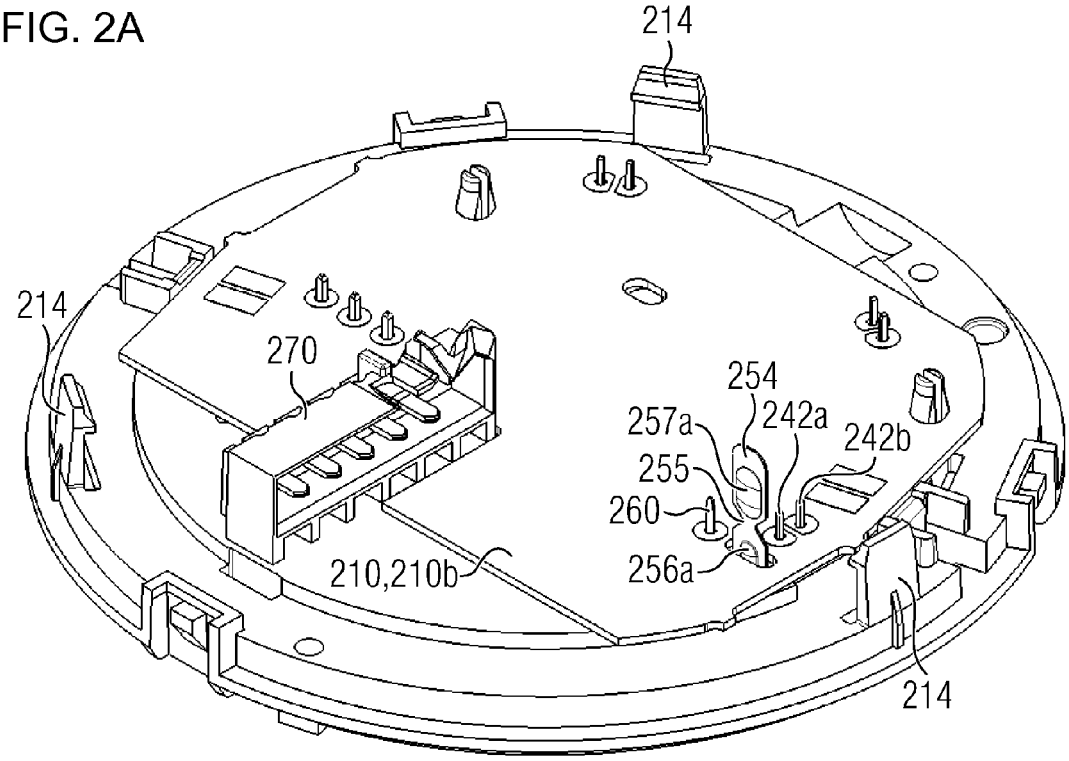
FIG. 2*a* shows a perspective view of the back side of the substrate illustrated in FIG. 1*a* with the shielding device installed.

FIG. 2*a* shows the back side of the substrate illustrated in FIG. 1*a*, which henceforth is provided with the reference character 210. Only the printed circuit board 210*b* of the substrate 210 can be seen in the perspective view shown in FIG. 2*a*. The snap hooks for the adapter plate (not shown) are provided with the reference character 214. Also illustrated above the printed circuit board level is a connector strip 270 which serves to provide electrical contact for the smoke alarm.

Only connector pins 242*a* and 242*b* of the photodiode which protrude through the substrate 210 and thus through the printed circuit board 210*b* can be seen in FIG. 2*a*. Furthermore, a terminal contact 260 is shown which serves to provide contact and in particular grounding for the shielding device.

FIG. 2*a* shows the shielding device in a state in which it is fixed after the rear shielding unit 254 or the metal strip 254 has been pushed through the substrate 210. Only a part of the rear shielding unit 254 can therefore be seen on the back side of the substrate 210. This part comprises a part of the first bulge 256*a*, the narrowing 255 and the second bulge 257*a*.

Figure 2B:
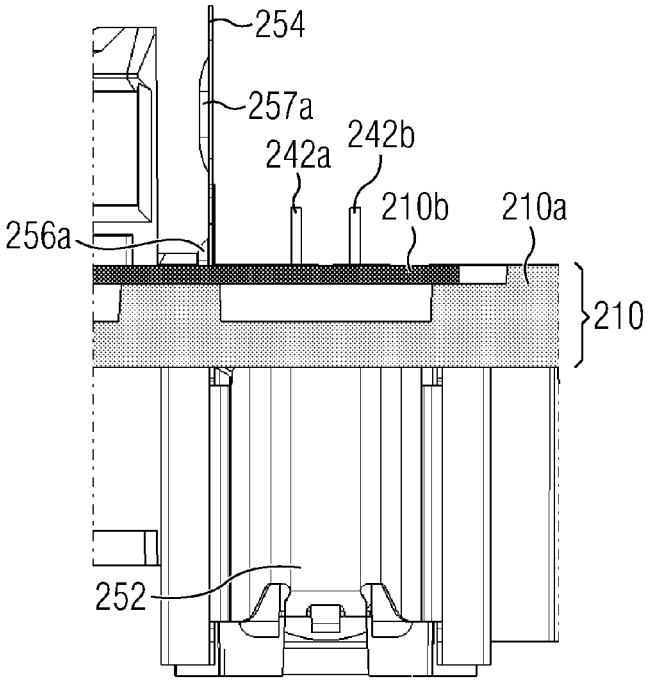
FIG. 2*b* shows a cross-sectional view of the installed shielding device.

FIG. 2*b* shows a cross-sectional view of the shielding device 250 installed in the substrate 210. The printed circuit board 210*b* and the mechanical support element 210*a* can be seen, constituting the components of the substrate 210 according to the exemplary embodiment illustrated here. Furthermore, the front shielding unit 252 of the shielding device which protects the actual photodiode against electromagnetic interference radiation can also be seen.

Figure 3A:
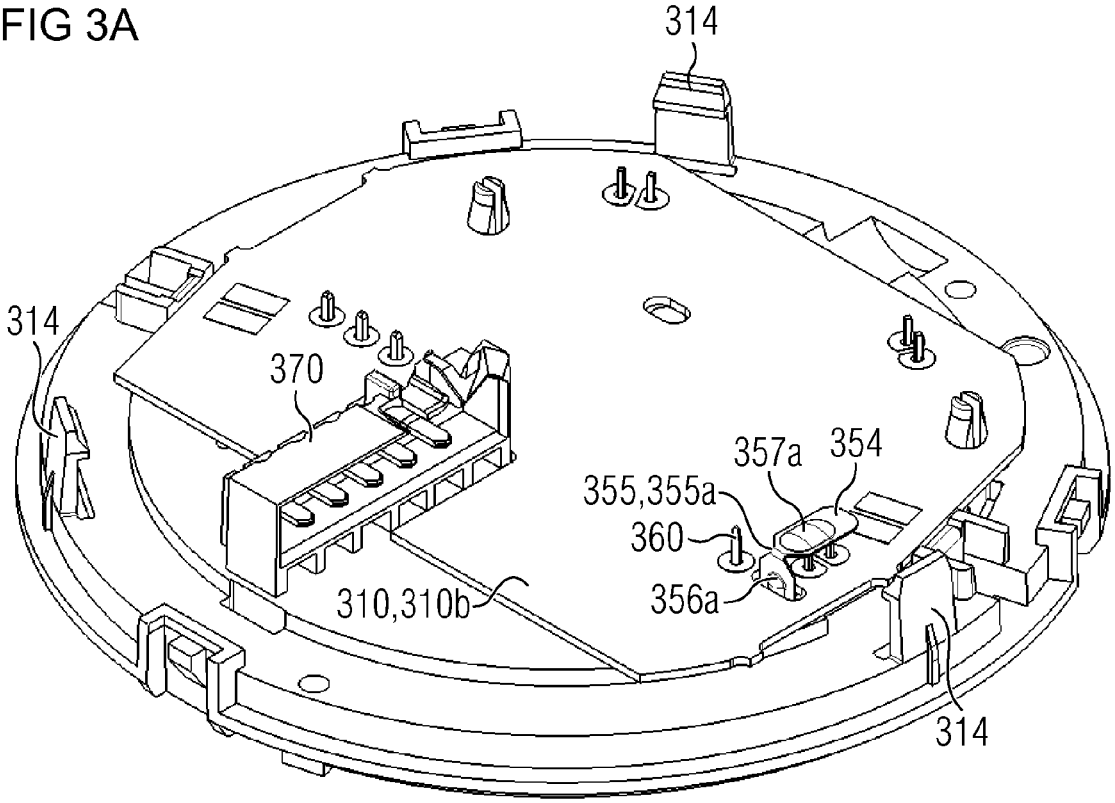
FIG. 3*a* shows a perspective view of the installed shielding device after a section of a rear shielding unit of the shielding device has been bent over.
Figure 3B:
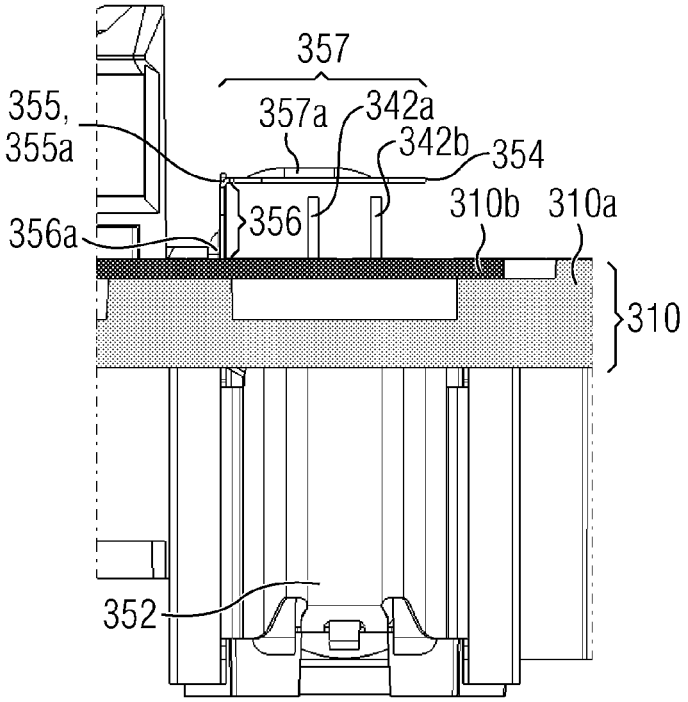
FIG. 3*b* shows a cross-sectional view of the installed shielding device with the bent-over section of the rear shielding unit.

FIGS. 3*a* and 3*b* show the installed shielding device after a section of the rear shielding unit 354 of the shielding device has been bent over, where FIG. 3*a* is a perspective view and FIG. 3*b* is a cross-sectional view.

The snap hooks for the adapter plate (not shown) are provided with the reference character 314. Also illustrated above the printed circuit board level is a connector strip 370 which serves to provide electrical contact for the smoke alarm.

Only connector pins 342*a* and 342*b* of the photodiode which protrude through the substrate 310 and thus through the printed circuit board 310*b* can be seen in FIG. 3*a*. Furthermore, a terminal contact 360 is shown which serves to provide contact and in particular grounding for the shielding device.

The front shielding unit 352 of the shielding device can be seen in FIG. 3*b*. The shielding device is fixed in self-retaining fashion in the substrate 310. The substrate 310 comprises the mechanical support element 310*a* and the printed circuit board 310*b*.

As can be seen from FIGS. 3*a* and 3*b*, the rear shielding unit or the metal strip 354 has been bent over in the region of the narrowing 355. The bend 355*a* produced thereby then demarcates a first section 356 having the first bulge 356*a* from a second section 357 having the second bulge 357*a*. According to the exemplary embodiment described here, the first section 356 essentially extends perpendicular to the substrate surface, whereas the second section 357 essentially extends parallel to the substrate surface. The second section of the rear shielding unit 354 thereby in particular protects the photodiode against the effects of electromagnetic interference radiation which impinges on the photodiode from above through the substrate or only from above on the terminal contacts 342*a*, 342*b* of the photodiode.

It should be noted that in order to improve the shielding effect of the rear shielding unit 354, the second section 357 can also be connected electrically conductively with the terminal contact 342*b* of the photodiode. This is useful especially when the terminal contact 342*b* is in any case connected with the electrical potential 0. In this situation, the electrically conductive connection can be effected simply by means of a defined mechanical contact between the front end of the second section 357 and/or by means of a soldered connection.

In this context it should be noted that the bulge 357*a* can serve not only to improve the mechanical stiffness of the rear shielding unit 354. As can be seen in particular from FIG. 3*b*, the upwardly formed bulge in the rear shielding unit 354 also helps to ensure that when the section 357 is bent over no electrical contact is accidentally established between the connector pin 342*a* of the photodiode and the rear shielding unit 354 or the entire shielding device. This is because such a contact would result in a short-circuit between the terminal contacts 342*a* and 342*b*.

The shielding device described in this application has the advantage that it can offer comprehensive protection against electromagnetic interference radiation with a minimum space requirement. This protection relates to the interference radiation which impinges on the photodiode from a front side of the substrate or from a rear side of the substrate (through the substrate). A further important advantage of the shielding device described is the simple and thereby also cost-effective assembly on or in a substrate.

It should be noted that the embodiments described here merely represent a restricted selection of possible embodiment variants of the invention. It is thus possible to combine the features of individual embodiments in a suitable manner with one another so that for the person skilled in the art a plurality of different embodiments is to be seen as obviously disclosed by the explicit embodiment variants here.

LIST OF REFERENCE CHARACTERS

100 Smoke alarm (without cover)
110 Substrate
110*a* Mechanical support element
112 Snap hook (for cover)
114 Snap hook (for adapter plate)
120 First light emitting device
130 Second light emitting device
140 Light receiver device
142 Light receiver/photodiode
144 Receiver lens
150 Shielding device
152 Front shielding unit
154 Rear shielding unit/metal strip
155 Narrowing
156*a* First bulge
157*a* Second bulge
210 Substrate
210*a* Mechanical support element
210*b* Printed circuit board
214 Snap hook (for adapter plate)
242*a* Terminal contact of photodiode
242*b* Terminal contact of photodiode
252 Front shielding unit
254 Rear shielding unit/metal strip
255 Narrowing
256*a* First bulge
257*a* Second bulge
260 Terminal contact
270 Connector strip
310 Substrate
310*a* Mechanical support element
310*b* Printed circuit board
314 Snap hook (for adapter plate)
342*a* Terminal contact of photodiode
342*b* Terminal contact of photodiode
352 Front shielding unit
354 Rear shielding unit/metal strip
355 Narrowing
355*a* Bend
356 First section
356*a* First bulge
357 Second section
357*a* Second bulge
360 Terminal contact
370 Connector strip

The invention claimed is:

1. A light receiver device for an optical smoke detector, the light receiver device comprising:

a flat substrate having a front side and a back side opposite said front side;

a light receiver mounted on said front side of said substrate; and a shielding device configured to shield said light receiver against electromagnetic interference radiation;

said shielding device having a front shielding unit and a rear shielding unit;

said front shielding unit being disposed on said front side of said substrate and said rear shielding unit being disposed on said back side of said substrate;

said rear shielding unit being a metal strip penetrating said substrate from said front side to said back side of said substrate and having a first and second section;

said first section extending essentially perpendicular to said surface of said substrate, said second section extending essentially parallel to said surface of said substrate;

said light receiver having terminal pins and said second section configured to shield terminal pins of said light receiver against electromagnetic interference radiation that penetrates said substrate.

2. The light receiver device according to claim 1, wherein said metal strip is fixed in a self-retaining fashion in said substrate.

3. The light receiver device according to claim 2, wherein said metal strip is formed with at least one bulge.

4. The light receiver device according to claim 1, wherein said shielding device is formed with a bend on said back side of said substrate, and said bend separates a first section and a second section of said shielding device from one another.

5. The light receiver device according to claim 4, wherein said shielding device is formed with a narrowing in a region of said bend.

6. The light receiver device according to claim 1, which further comprises a terminal contact for providing electrical contact with said shielding device.

7. The light receiver device according to claim 1, wherein said substrate comprises a printed circuit board.

8. The light receiver device according to claim 1, wherein said substrate has a mechanical support element.

9. The light receiver device according to claim 1, wherein said light receiver is a photodiode.

* * * * *